United States Patent [19]

Wagner

[11] 4,027,352

[45] June 7, 1977

[54] SCOURING PAD WITH RETAINED CONTOURED STIFFENER

[76] Inventor: Walter Wagner, 2 Spring Drive, Dumont, N.J. 07628

[22] Filed: July 22, 1976

[21] Appl. No.: 707,638

[52] U.S. Cl. ..... 15/209 C

[51] Int. Cl.[2] ..... A47L 17/08

[58] Field of Search ..... 15/104.93, 209 B, 209 C, 15/209 D, 208; 51/400, 401, 403, 404

[56] References Cited

UNITED STATES PATENTS

| | | | |
|---|---|---|---|
| 1,638,800 | 8/1927 | D'Albora | 15/209 D X |
| 2,093,268 | 9/1937 | Dyer | 15/209 C |
| 2,375,585 | 5/1945 | Rimer | 51/400 |
| 3,039,125 | 6/1962 | Benjamin | 15/209 C X |
| 3,629,896 | 12/1971 | Sirnec | 15/209 B X |

FOREIGN PATENTS OR APPLICATIONS

| | | | |
|---|---|---|---|
| 859,533 | 6/1940 | France | 15/209 D |

*Primary Examiner*—Daniel Blum
*Attorney, Agent, or Firm*—Ralph R. Roberts

[57] ABSTRACT

There is disclosed a scouring pad made with a strip of expanded plastic material which is commonly used for scouring pots, pans and the like. This pad has one end folded over a stiff plastic contoured member which provides a controlled contour to the pad and allows the pad to be folded for gripping by the fingers. The contoured insert provides four corners for ease of scouring and cleaning. Two corners of this insert are curved and two corners are sharp or right-angled permitting easy and thorough cleaning of the contours, ridges, indentations, etc. of pots, pans and the like.

7 Claims, 4 Drawing Figures

SCOURING PAD WITH RETAINED CONTOURED STIFFENER

BACKGROUND OF THE INVENTION

1. Field of the Invention

With reference to the classification of art as established in the United States Patent and Trademark Office the present invention is found in the Class entitled, "Brushing, Scrubbing and General Cleaning" (Class 15) and more particularly in the subclass thereunder entitled, "wipers, daubers and polishers - fibrous mass" (subclass 209C) and also in the subclass entitled, "laminated" (subclass 225).

2. Description of the Prior Art

The present invention is found in the class of scourers and the art is this class is very crowded. In this art particular note is to be made of soap pads in which soap as bars, powders or liquid is carried within wool-like members and/or metal members. For example, "Brillo" (TM) pads.

Recently pads of nylon have been utilized to provide scourers. The nylon fibers are formed to make a pad and are made sufficiently abrasive to remove cooking residue on pots, pan and the like. After a short period of use these rectangular pads lose their stiffness and become limp and hard to use. In the attempt to stiffen these pads for easy gripping and extending their usefullness as pads, internal stiffeners are provided but these stiffeners have been run to the extreme edge of the pad. Pads so formed have not provided any contour or cushioning as is desired when curved or sharp corners of the pots and pans are to be cleaned.

In the present invention a plastic stiffening member is laminated in position in one end of the pad which is folded over this plastic insert. The edges of this outer nylon fibrous member are secured so that the edges extend outwardly approximately one-quarter of an inch from the edge of the plastic stiffener. Two corners of the plastic stiffener are formed with a radius which allows the stiffened plastic outer pad to conform to the curve between the bottom and side of the pan. The other end of the corners of the stiffener are relatively sharp corners which enables the outer pad to be supported even when an approximately 90 degree area or corner in a pan or dish is presented. This particularly occurs in cake pans, pie tins and the like. A residual piece of this pad extends beyond the laminated reinforcement and provides a fold-over piece which permits replenishment or an additional cushioning to the curve end. This extending end is often folded over the laminated portion so that the sharp ends also have an additional thickness scouring over the reinforcing stiffener. The stiffener in the preferred instance is made with access holes which are used for securing the plastic material to itself and to enclose the stiffener between layers of the outer pad member either by stitching, sonic welding, adhesive, etc.

SUMMARY OF THE INVENTION

The present invention contemplates a rectangular expanded plastic scourer of conventional construction with one end of the outer member folded over and enclosing a plastic stiffener. This plastic stiffener has two of its external corners rounded and the other two corners with more-or-less sharp corner edges. This stiffener is secured so that it is interior of the edges of the pad which are then sealed by any appropriate means to retain the plastic stiffener as an internal member. The pad so formed has a residual portion which may be folded over to give a double thickness at the curved end portions of the plastic support. This allows a renewal of the scourer to be made at both its curved corners and at its other end to also provide a double thickness and/or renewal at the straight corners. The expanded plastic pad may be of any conventional construction but the contemplated construction is one of nylon conventionally available and conventionally supplied as rectangular strips or sheets.

In addition to the above summary the following disclosure is detailed to insure adequacy and aid in understanding of the invention. This disclosure is intended to cover each new inventive concept therein no matter how it may later be disguised by variations in form or additions of further improvements. For this reason there has been chosen a specific embodiment of the scrubbing pad with a retained contoured stiffener as adapted for use in cleaning pots, pans and the like and showing a preferred means for the construction of this scourer. This specific embodiment has been chosen for the purposes of illustration and description as shown in the accompanying drawing wherein:

BRIEF DESCRIPTION OF THE DRAWING

In the following description and in the claims various details will be identified by specific names for convenience, these names, however, are intended to be generic in their application. Corresponding reference characters refer to like members throughout the four figures of the drawing.

Figure 1:
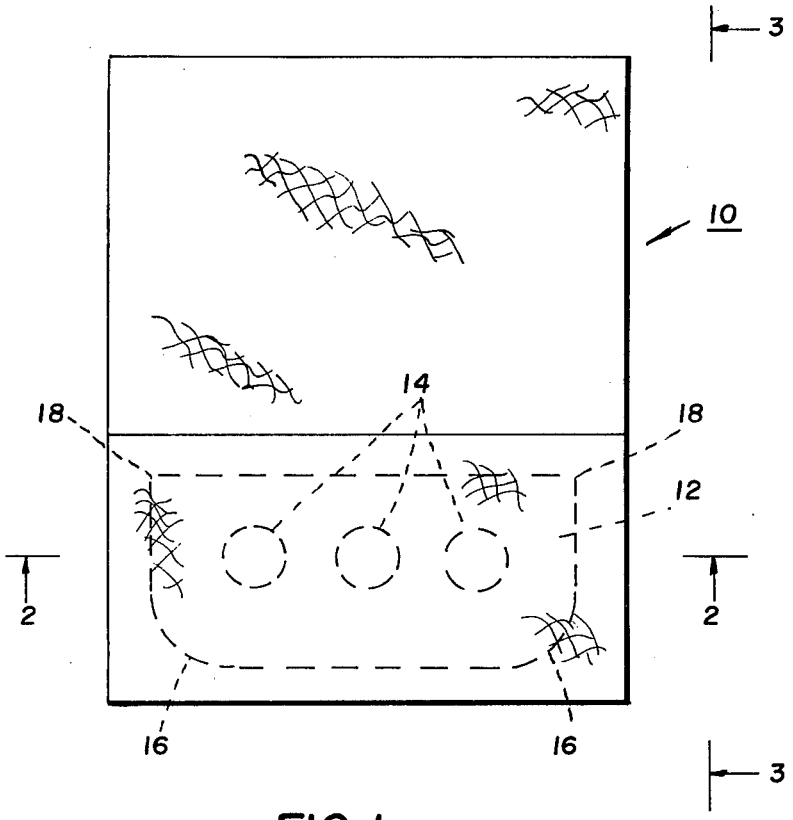
FIG. 1 represents a plan view of the assembled reinforced scrubber of this invention.
Figure 3:
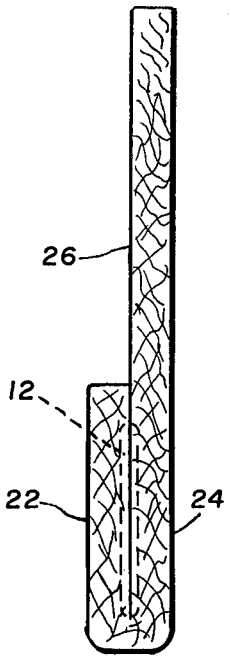
FIG. 3 represents a side view of the scourer of FIG. 1 and looking in the direction of the arrows.
Figure 2:
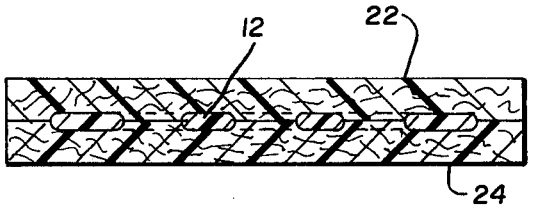
FIG. 2 represents a sectional view taken on the line 2—2 of FIG. 1 and looking in the direction of the arrows.

The drawing accompanying, and forming part of, this specification discloses certain details of construction of the scourer but it should be understood that details may be modified in various respects without departure from the concept of the invention and that the invention may be incorporated in other structural forms than shown.

DESCRIPTION OF THE PREFERRED EMBODIMENT OF FIGS. 1 THROUGH 4

Figure 4:
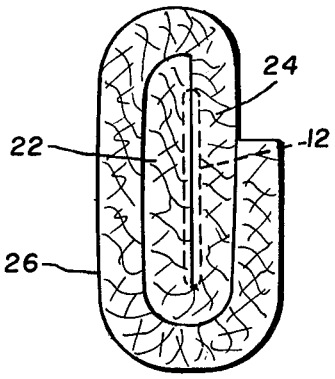
FIG. 4 represents a section similar to FIG. 3 with the free end of the scourer folded around the remainder of the scourer and ready for use.

Referring now to the single sheet of drawings and the four FIGS. thereon, it is to be noted that a plastic rectangular scouring member is generally identified as 10. This member is folded at one end to enclose a reinforcing or stiffening plastic member 12. For ready securing attachment of this member 12 to the rectangular scrubbing piece 10 there are provided and shown in the present embodiment three apertures 14. These apertures may be used for sonic welding, impulse or heat welding of the outer plastic member of the scourer to itself or for an application of glue, stitching or the like. The stiffener 12 is formed with its lower edge or side, as viewed, having two radiused corners generally identified as 16. The other or opposite end of this stiffener is formed with sharp corners 18. This reinforcing member 12 is contemplated as being at least one-sixteenth of an inch thick and is approximately one quarter of an inch inwardly from the pad edges. This allows the edges to be brought together to retain this stiffener in the pad and also enables these edges to provide, more-or-less, stiffened cleaning portions of a continuous scouring member. The near folded portion of the outer member 10 is identified as 22. The far portion of the outer plastic member is identified as 24. The free end or unlaminated portion is identified as 26. In the folded-over condition, as seen in FIG. 4, the portion 26 may be brought over and around the portion 22 to form a three and four section sandwich, as seen in FIG. 4.

USE AND OPERATION

In the manufacture of this item, high speed automatic equipment is contemplated to be used. Whether an adhesive is used to retain the stiffener 12 in place or some appropriate welding or stitching is used is merely a matter of preference. In the completed state it is contemplated that the stiffener 12 will be maintained in a position whereby both front and back portion 22 and 24 are available for scouring of a pot or pan. For the scouring of a curved corner or confluence of the side or bottom it is contemplated that a curved end of the pad such as that end containing the curved portion 16 of the stiffener 12 will be utilized. If this corner is not sharp enough then the pad corner using the right angle corners 18 of the stiffener may be utilized. A big portion of the padding may be utilized either as a single ply or folded pad, if desired. As the pad wears or more thickness of the material is desired for ease of hand gripping, the tail or unlaminated end portion 26 is folded over the laminated portion as in FIG. 4. This folded portion makes a sandwich piece which provides both curved corners 16 as supported by the stiffener or sharper corners as provided by the stiffener at corners 18. The ends or longer edges of the pad may be used as well as the sides of the scourer.

It has been found that a stiffener of this configuration enables substantially all pots and pans to be easily scrubbed. The corners in the pans as made by the various manufacturers are of many fanciful shapes and these are easily cleaned by a scourer having a stiffener with both curved and sharp corner configurations. With the additional plastic portion 26 provided on this scourer, an extremely long life is provided. This is in contrast to those scourers that are used a few time and then thrown away because they have lost their rigidity and their ability to be pressed into a sharp or near sharp corner for cleaning. This stiffener of this invention provides a scrubber pad having an ability to withstand rough usage and perform satisfactorily for a long time.

While the scourer, above-described, has been described in the terms of the fold-over portion being from a sheet of material this is not to preclude the making of the outer cover as a molded member with the plastic insert held in place by pins during the filling of the mold with cellular material to provide the desired scouring capability. The thickness of the outer member may be as little as ⅛ inch thickness but preferably the thickness is at least ¼ inch. The length of the free end is at least one and one-third the length of the dual thickness portion which contains and forms the stiffening insert. A length of one and three-quarter times the length of the dual thickness portion is preferable since this allows the free portion to be brought to and around both ends enabling the corner portions to be twice used before wearing through. The insert may be of any suitable plastic sheet material that is at least semirigid and is substantially impervious to water at least for the period of time the scrubber is contemplated as being used. Whether the outer member is molded, glued, welded or stitched to the stiffener is merely a matter of economic choice. The providing of a free length extends the length of service and permits a cushioning for the fingers of the hand when brought to its foldover condition.

The use of the stiffener in the above described pad insures a large scouring surface no matter how gripped by the user of the pad. This saves the fingernails of the user or housewife who does not have to spread the area of the pad. In addition to the effective area the enclosed edges when the pad is pushed into the corners easily scours the convolutions formed in the pots and pans.

Terms such as "up," "down," "bottom," "top," "front," "back," "in," "out," and the like are applicable to the embodiment shown and described in conjunction with the drawing. These terms are merely for the purpose of description and do not necessarily apply to the position in which the scourer may be constructed or used.

While a particular embodiment of this scourer and its construction has been shown and described it is to be understood modifications may be made within the scope of the accompanying claims and protection is sought to the broadest extent the prior art allows.

What is claimed is:

1. A plastic scouring pad for pots, pans and the like in which the pad is made of a size sufficiently small to be easily folded for hand manipulation, the outer surface of the pad being sufficiently open and abrasive to clean unwanted debris from the surfaces of said pots, pans and the like, said scouring pad including: (a) an outer member of a selected thickness of at least ⅛ inch and of a generally rectangular configuration and of a plastic, non-woven, fibrous open construction for the scouring of the surface of said pots, pans and the like, and (b) an insert of stiff plastic sheet material which is at least one-sixteenth of an inch thick and is impervious to the effect of water and detergents during its period of use, the insert being generally rectangular and having at least one corner formed with a radius and at least one of the other corners formed with a substantially 90 degree sharp configuration, said insert secured as an internal member within a fixed foldover end portion of the outer member to provide a double thickness, said end portion of the outer member completely enclosing the faces and all edges of the insert to provide at least three-sixteenths of an inch border of the outer member around the insert, the outer member also being constructed so as to provide an attached free end portion extending for at least one and one-third times the length of the double thickness portion of the outer member, the attached free end providing means for said free end to be brought to and around the double thickness to provide an additional thickness of scouring material at the edges and corners of the insert.

2. A plastic scouring pad as in claim 1 in which the insert has two radiused corners and two sharp corners and there is formed in its midportion a plurality of apertures through which the outer member portion is secured.

3. A plastic scouring pad as in claim 1 in which the outer member is of Nylon fiber and is at least ¼ inch thick.

4. A plastic scouring pad as in claim 1 in which the outer member is of molded cellular construction and the insert is held in position during the molding of the outer member.

5. A plastic scouring pad as in claim 1 in which the insert is secured in position by welding.

6. A plastic scouring pad as in claim 1 in which the insert has a plurality of apertures formed in its midportion and the insert is secured as by stitching through the apertures.

7. A plastic scouring pad as in claim 1 in which the free end is one and three-quarters times longer than the double thickness portion enclosing the insert.

* * * * *